United States Patent [19]

Tenteris et al.

[11] 3,942,518

[45] Mar. 9, 1976

[54] THERAPEUTIC INTERMITTENT COMPRESSION APPARATUS

[75] Inventors: Ansis U. Tenteris; Bruce W. Wetzel; Dennis G. Mosiniak, all of Toledo, Ohio

[73] Assignee: Jobst Institute, Inc., Toledo, Ohio

[22] Filed: Mar. 18, 1974

[21] Appl. No.: 451,955

[52] U.S. Cl. ..... 128/24 R; 128/64; 128/DIG. 10; 137/624.14

[51] Int. Cl.[2] ..... A61H 1/00; E03B 3/00

[58] Field of Search ..... 128/24 R, 28, 64, DIG. 10, 128/DIG. 20; 137/624.14

[56] References Cited

UNITED STATES PATENTS

| | | | |
|---|---|---|---|
| 2,071,215 | 2/1937 | Petersen | 128/24 R |
| 3,390,674 | 7/1968 | Jones | 128/DIG. 10 |
| 3,811,431 | 5/1974 | Apstein | 128/64 |

*Primary Examiner*—Lawrence W. Trapp
*Attorney, Agent, or Firm*—David H. Wilson

[57] ABSTRACT

An apparatus for intermittently applying compression to a portion of a patient's body enclosed in a therapeutic appliance. A timer is operated from a regulated pressurized fluid source to generate control signals to a valve which alternately inflates and deflates the appliance. The elements of the timer may be time delay valves, penumatic timing valves or fluidic elements which function to produce adjustable timing intervals for the control signals whereby the inflation and deflation intervals and the cycle time may be manually changed.

21 Claims, 4 Drawing Figures

THERAPEUTIC INTERMITTENT COMPRESSION APPARATUS

BACKGROUND OF THE INVENTION

1. Field of the Invention

This invention relates to medical apparatus and more particularly to an apparatus for intermittently applying external compression to a portion of a body for therapeutic purposes, for example to prevent complications of the circulatory system such as pulmonary embolism.

2. Description of the Prior Art

One of the most serious complications which occurs after surgery has been pulmonary embolism. Although it is generally accepted that venous stasis in the lower extremities is the major factor in venous thrombosis and subsequent pulmonary embolism, such a condition is difficult to detect since clots in the veins of the legs and pelvis produce symptoms only when they become attached to the vein wall and the greatest danger of pulmonary embolism is already passed. Methods of prevention and treatment have included early ambulation, post-operative exercises in bed, use of anti-coagulants, the electrical stimulation of calf muscles during surgery and wrapping the legs during and after surgery.

However, one of the most successful methods of treatment has been the intermittent application of pressure to the legs. Collens et al Patent No. 2,140,898 entitled "Method of and Apparatus For Producing Intermittent Venous Occlusion" discloses a device for applying pressure to a leg to obstruct the venous flow for a relatively short period of time at a predetermined frequency. Although such devices produced the desired results, they required a source of electricity to power the timing means, electric motor and/or valves which controlled the air pressure for the pneumatic cuff or boot on the patient's leg. The introduction of such apparatus into the operating room required the units to be made explosion proof which greatly added to their weight, bulk and cost. These negative factors militated against general acceptance of intermittent compression devices

SUMMARY OF THE INVENTION

The present invention is intended to overcome the safety, weight and size problems inherent in a therapeutic intermittent compression apparatus having electrically operated elements. The timing elements and associated valves are operated from pressurized fluid sources, typically the same pressurized fluid source as is utilized to inflate the therapeutic appliance enclosing a portion of the patient's body. Therefore, there is no requirement for a source of electrical power. The small size and light weight and freedom from the requirement for an electrical power source permit the present invention to be used advantageously for the rapid treatment of injuries. For example, an ambulance may carry the present invention and a tank of compressed gas for use at the scene of an accident or on the way to a hospital. The present invention and a tank of compressed gas stationed at an atheletic contest permits immediate treatment of an injury.

The first embodiment of the present invention has two time delay valves which are alternately actuated by a control valve to generate on and off signals. The time intervals of the on and off signals are independently adjustable to provide various periods of inflation and deflation respectively for the therapeutic appliance. A second embodiment of the present invention has two pneumatic timers which are alternately actuated by a control valve to generate the on and off signals for independently adjustable time intervals. A third embodiment has a fluidic timer including a free running oscillator generating a train of timing pulses. Two pneumatic counters count donw from preset numbers, one count for each timing pulse, to define the timing intervals of the periods of inflation and deflation.

An object of the present invention is to improve theraputic intermittent compression units.

Another object is to eliminate the need for and potential hazard of electrical controls and power for theraputic intermittent compression units.

A third object is to reduce the weight and bulk of therapeutic intermittent compression units.

A fourth object is to operate a therapeutic intermittent compression unit by means of pressurized fluid whereby it is independent of electrical sources and is operative in locations remote from such sources.

Another object of the present invention is to provide a fluid pressure operated therapeutic intermittent compression apparatus for alternately inflating and deflating an appliance enclosing a portion of a patient's body.

It is a further object of the present invention to provide a therapeutic intermittent compression apparatus with adjustable timing intervals for the appliance inflating and deflating periods.

DESCRIPTION OF THE PREFERRED EMBODIMENT

Figure 1:
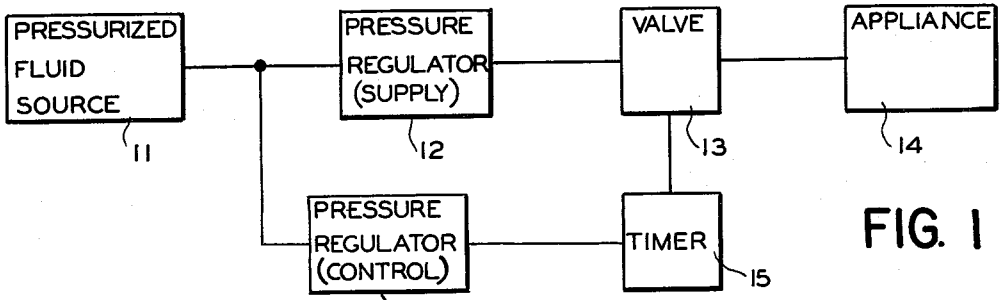
FIG. 1 is a block diagram of the present invention.

Referring to FIG. 1, there is shown a block diagram of an intermittent compression apparatus according to the present invention. Fluid is supplied at both the supply pressure and control pressure from pressurized fluid source 11, typically a source of compressed air or other gas which is readily available in hospitals in operating and post-operative areas. Pressure regulator 12 is adjustable to maintain a constant predetermined supply pressure through valve 13 to appliance 14. Typically appliance 14 may be a pressure cuff or an inflatable boot which encloses a portion of the body and applies pressure to that portion of the body upon being supplied with compressed gas through valve 13. Timer 15 is supplied from pressure regulator 16 which issues fluid at a constant predetermined control pressure to generate an "on" signal for a first predetermined period of time and an "off" signal for a second predetermined period of time. Valve 13 responds to the on signals, and output at the control pressure of the pressurized fluid, by connecting supply pressurized fluid to appliance 14 from pressure regulator 12 to inflate appliance 14 for the first predetermined period of time. When timer 15 switches its output to the off signal, valve 13 disconnects pressurized fluid source 11 and vents appliance 14 to the atmosphere, so that it will deflate. As this timing cycle is repeated appliance 14 intermittently applies compressive force to the enclosed portion of the body thereby stimulating circulation.

An advantageous arrangement of the system of FIG. 1 requires only a single source of pressurized fluid. However, it is to be recognized that the pressurized fluid operated timer and/or the valve operators could be driven from sources separate from that supplying pressurized fluid to the appliance. Frequently the timer 15 operates at different pressures than those required for the appliance 14. A preferred technique in such circumstances is to provide a first pressure control for the appliance and a separate second pressure control for the timer. Typically, the timer operates on higher pressures than the appliance and the controls can be placed in tandem with the control for the lower pressure device behind the control for the higher pressure and branched from that control. Thus, where appliance 14 operates on a lower pressure than the timer and valve controls, it can incorporate a regulator behind the regulator for the controls. Where the pressurized fluid source has an internal regulator the source can be regulated to the control pressure and only a regulator 12 to establish the lower appliance supply pressure is required in the intermittent compression unit assembly.

Figure 2:
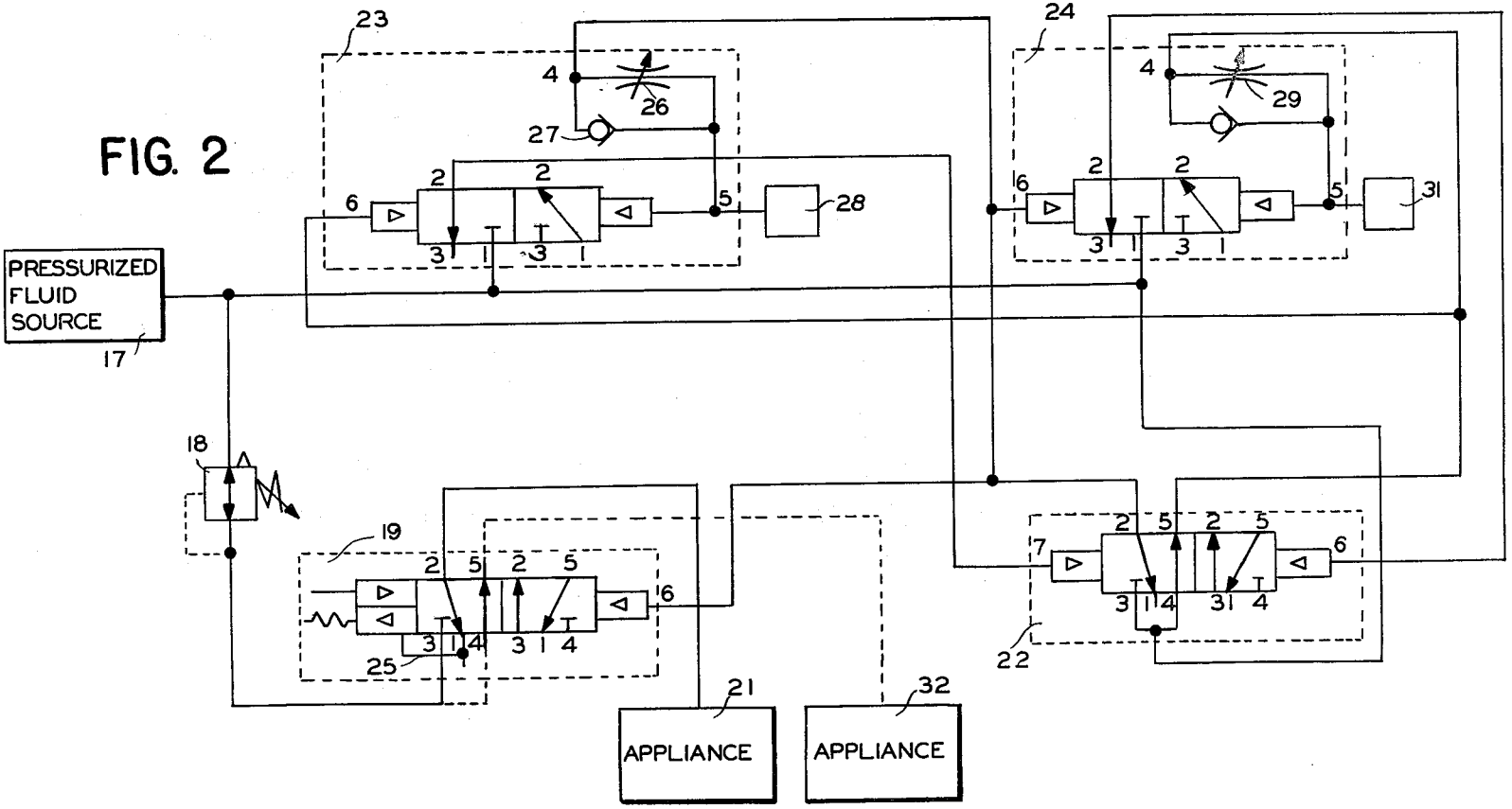
FIG. 2 is a schematic diagram of the present invention which includes a delay valve timer.
Figure 3:
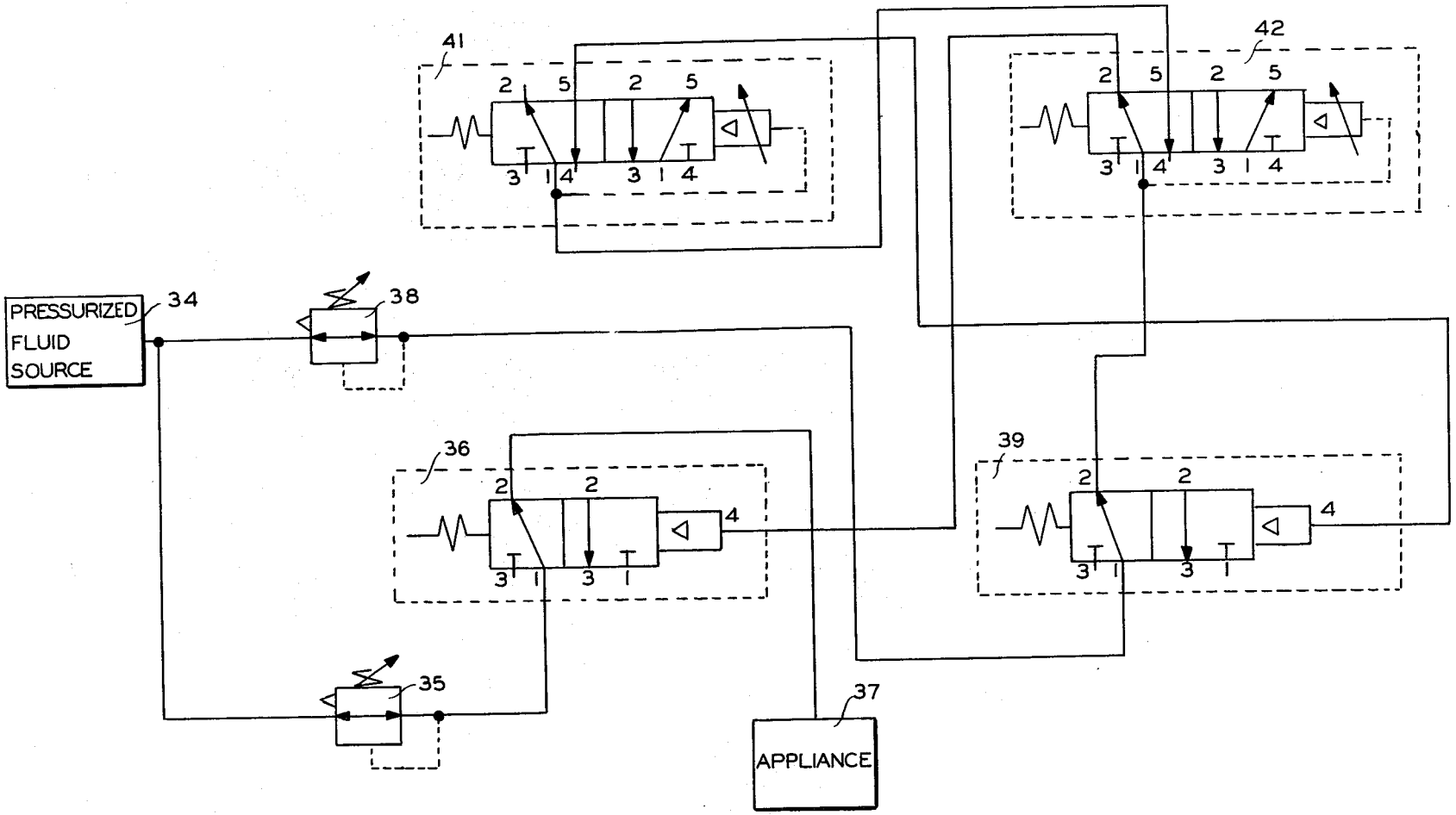
FIG. 3 is a schematic diagram of an alternate embodiment of the present invention which includes pneumatic timers.
Figure 4:
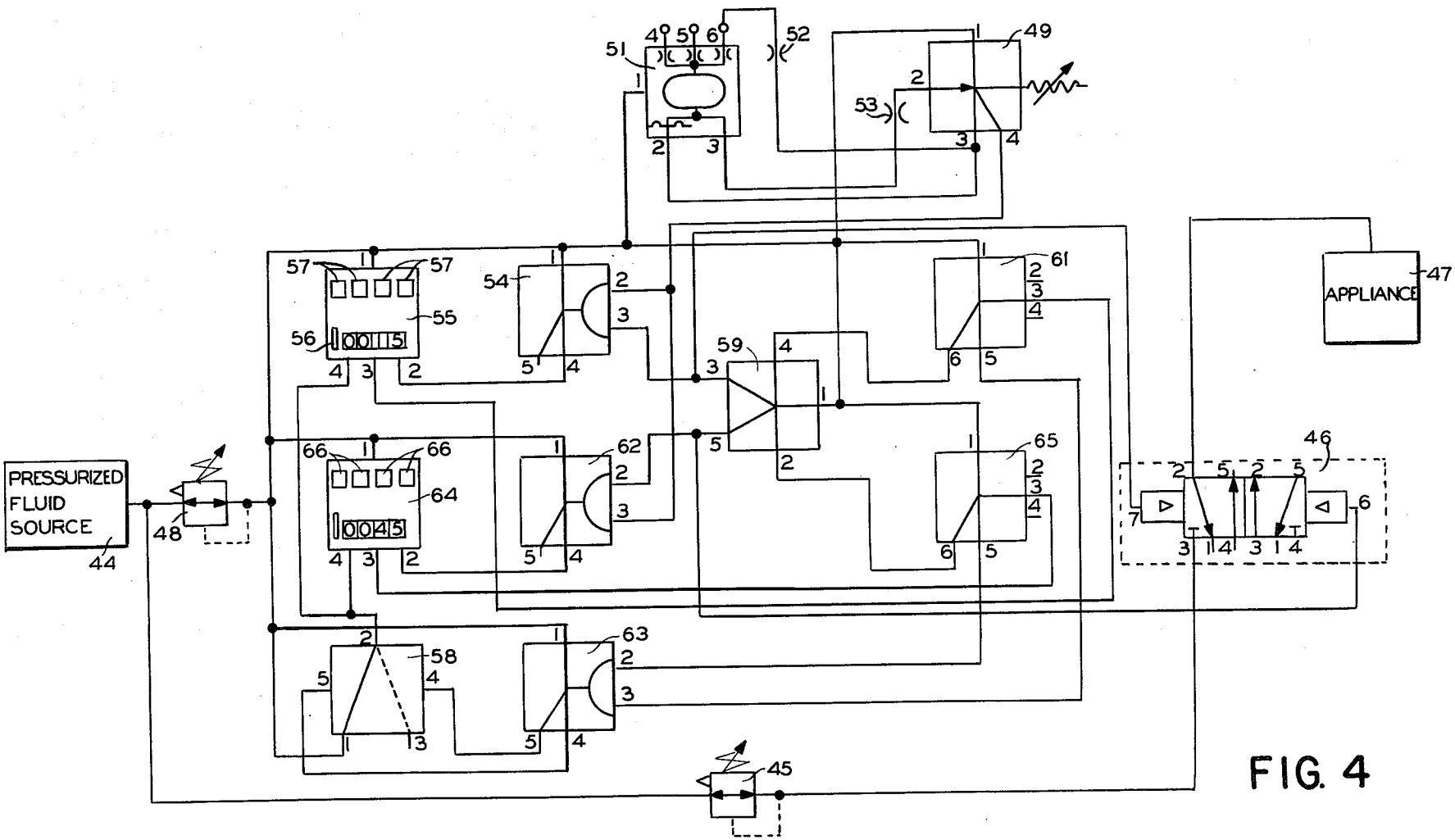
FIG. 4 is a schematic diagram of a second alternate embodiment of the present invention which includes a fluidic timer.

FIG. 2 is a schematic diagram of one embodiment of the present invention having a delay valve timer. Pressurized fluid source 17 supplies a compressed gas regulated to a control pressure through pressure regulator 18, to maintain a constant appliance supply pressure, and four-way valve 19 to appliance 21. Regulator 18 maintains a constant fluid pressure of typically one p.s.i. (pound per square inch) at valve 19 and appliance 21. A pressure of approximately one p.s.i. has been found to an optimum value for preventing pulmonary embolism while preserving patient comfort. Valves 22, 23 and 24 co-operate to produce alternate on and off control signals at a predetermined cyclic rate. Valve 19 responds to the control signals to intermittently inflate appliance 21 from pressurized fluid source 17 and deflate appliance 21 by venting it to the atmosphere. In FIGS. 2, 3 and 4 the valves are represented schematically with the left center portion of each symbol showing the internal connections between ports in the normal valve positions and the right center portion showing the internal connections when the valve is actuated. Each valve port is numbered and will be designated by valve and port number such as exhaust port 19-1 of valve 19.

Element 19 is a four-way memory valve with an automatic reset. As shown in the left center portion of the schematic symbol, in the normal state exhaust port 19-1 is connected to output port 19-2, as represented by the arrowheaded, interconnecting line which in turn is connected to appliance 21. The arrowheads indicate the direction of gas flow through the valve. Therefore, appliance 21 will be vented to atmosphere in the normal valve position. Input port 19-3 is normally closed, as represented by the T termination for the normal position, while port 19-4 is connected to output port 19-5. When an on control signal in the form of compressed gas is applied at pilot port 19-6, valve 19 is switched to the actuated position as shown in the right center portion of the schematic symbol. Input port 19-3, which is supplied with pressure regulated compressed gas through pressure regulator 18, is connected to output port 19-2 in the actuated position and appliance 21 is inflated for a first predetermined period of time. When the on control signal is removed and the off control signal, in the form of venting to atmosphere, is applied to pilot port 19-6, valve 19 will automatically reset to the normal position. The reset mechanism is spring actuated to provide a substantially instantaneous switch in states. Exhaust port 19-1 is internally connected to an air-retracted spring by line 25 so that if no compressed gas is present at exhaust port 19-1 and no on control signal is present at pilot port 19-6 the spring will reset the valve and appliance 21 will deflate. Valve 19 and other valves utilized in the present invention switch with a snap action so as to minimize delay between the application of a control signal and the switching of the valve position.

Element 22 is a four-way valve having exhaust port 22-1 which is connected to output port 22-2 in the normal valve position. Input port 22-3 is normally closed while input port 22-4 is connected to output port 22-5. An on control signal at pilot port 22-6 will switch valve 22 to the actuated position as shown in the right center portion of the symbol. An on control signal at pilot port 22-7 will return valve 22 to its normal position. Elements 23 and 24 are three-way delayed-in normally closed valves with adjustable flow controls to provide the delay-in function. As shown in the left center portion of the schematic symbol, input port 23-1 is normally closed and output port 23-2 is connected to exhaust port 23-3. A control signal applied to pilot port 23-4 is delayed by a uni-directional flow regulator comprising manually adjustable flow restrictor 26 and check valve 27. Restrictor 26 acts as a controlled linear resistance which delays the passage of the control signal at pilot port 23-4. Restrictor 26 is bypassed when there is flow out of pilot port 23-4 to eliminate the delay as check valve 27 will open. This allows accumulator 28, connected to output port 23-5 to provide additional time delay for the control signal by acting as a capacitor, to be exhausted quickly in preparation for the next cycle. The delayed on control signal at pilot port 23-4 will cause valve 23 to switch to the actuated position as shown in the right center portion of the symbol. An on control signal at pilot port 23-6 will reset the valve to the normal position. Since the delay time is pressure dependent, the pilot ports must be supplied from a regulated source of compressed gas to provide a time delay which may be manually adjusted.

When the pressurized fluid source 17 is turned on, relatively high pressure compressed gas, typically regulated at 50 p.s.i., is supplied to pressure regulator 18 which maintains a pressure of approximately 1 p.s.i. at input port 19-3 of valve 19. Since there is no control signal at pilot port 19-6, valve 19 will remain in the normal position and appliance 21 will be vented to the atmosphere through output port 19-2 and exhaust port 19-1. The compressed gas from source 17 is also applied at input port 22-4 of control valve 22 where it is passed through to output port 22-5 and applied as an on control signal at pilot port 23-6 of delay valve 23 and pilot port 24-4 of delay valve 24. Delay valve 23 will remain in the normal position so that output port 23-2 is vented to atmosphere through exhaust port 23-3 to place an off control signal at pilot port 22-7 of control valve 22. The on control signal at pilot port 24-4 will be delayed by flow restrictor 29 and reservoir 31 for a predetermined interval of time. When delay valve 24 switches to the actuated position, compressed gas will flow through the valve from input port 24-1 to output port 24-2 to produce an on control signal at pilot port 22-6 of control valve 22. Control valve 22 will switch to the actuated position to connect the compressed gas at exhaust port 22-3 to output port 22-2 to produce an on control signal at pilot ports 19-6, 23-4 and 24-6. The on control signal at pilot port 19-6 switches valve 19 to the actuated position which connects the compressed gas from regulator 18 at input port 19-3 to appliance 21 at output port 19-2. The compressed gas inflates appliance 21 which applies a constant pressure to the enclosed portion of the body.

The on control signal from output port 22-2 of control valve 22 is also applied at pilot port 24-6 of delay valve 24 which then switches to the normal position to place an off control signal at pilot port 22-6 of control valve 22. However, control valve 22 will remain in the actuated position since there is an off control signal at pilot port 22-7. Pilot port 23-4 also receives the on control signal which is delayed by flow restrictor 26 and reservoir 28 for a predetermined interval of time. When delay valve 23 switches to the actuated position, compressed gas will flow through the valve from input port 23-1 to output port 23-2 to produce an on control signal at pilot port 22-7 of control valve 22. Control valve 22 will switch to the normal position which will place an on control signal at pilot port 23-6 to reset delay valve 23 to its normal position and pilot port 24-4 to switch delay valve 24 to its actuated position after a predetermined time interval. The switching of control valve 22 to its normal position will also produce an off control signal at pilot ports 23-4, 24-6 and 19-6. Valve 19 will automatically reset to its normal position to deflate appliance 21 by venting to the atmosphere through output port 19-2 and exhaust port 19-1. The automatic resetting of valve 19 to vent appliance 21 also provides a safety feature in the event that there is a failure of fluid source 17 while valve 19 is actuated.

In summary, appliance 21 is inflated from pressurized fluid source 17 and pressure regulator 18 through valve 19 during a first predetermined period of time represented by the time delay associated with delay valve 23 after control valve 22 supplies an on control signal at pilot port 23-4. Appliance 21 is deflated during a second predetermined period of time represented by the time delay associated with delay valve 24 after control valve 22 supplies an on control signal at pilot port 24-4. Both time delays are manually adjustable so that each time interval as well as the total cycle time may be controlled over a range. In a typical application, the first time interval may be forty-five seconds of applied pressure followed by a second time interval of fifteen seconds of no applied pressure for a total cycle time of one minute. A second appliance 32 may be connected to output port 19-5 while input port 19-4 is connected to the compressed gas source as shown by the dashed lines in FIG. 2. This second appliance would then be inflated and deflated according to a cycle wherein the deflation period is the first predetermined time interval and the inflation period is the second predetermined time interval.

Referring to FIG. 3, there is shown an alternate embodiment of the present invention which includes pneumatic timers. Pressurized fluid source 34 supplies a compressed gas through pressure regulator 35 and three-way valve 36 to appliance 37. Compressed gas is also supplied through pressure regulator 38 to valves 39, 41 and 42 which co-operate to produce on and off control signals at a predetermined cyclic rate. Valve 36 responds to these control signals to intermittently inflate appliance 37 from pressurized fluid source 34 and deflate appliance 37 by venting it to the atmosphere. Element 36 is a three-way valve with an automatic reset. As shown in the left-center portion of the schematic symbol, input port 36-1 is normally connected to output port 36-2 which in turn is connected to appliance 37. Therefore, appliance 37 will be connected to the source of compressed gas, typically regulated at 1 p.s.i., in the normal valve position. Exhaust port 36-3 is normally terminated but is connected to output port 36-2 when an on control signal is received at pilot port 36-4 to vent appliance 37 to the atmosphere in the actuated position of valve 36.

Element 39 is also a three-way valve with an automatic reset which connects input port 39-1 to output port 39-2 in the normal position and connects output port 39-2 to exhaust port 39-3 in the actuated position. Elements 41 and 42 are pneumatic timing valves which operate in a pressure range of 1 to 15 p.s.i. Pressure regulator 38 maintains the compressed gas at a constant pressure, typically 10 p.s.i., at valves 39, 41 and 42. Pneumatic timer 42 has input port 42-1 connected to output port 42-2 in the normal position. When compressed gas is applied at input port 42-1, a manually adjustable timing cycle is initiated during which the valve remains in the normal position. At the end of the timing cycle output port 42-2 is connected to exhaust port 42-3 as valve 42 is actuated. When the signal is removed from input 42-1 pneumatic timing valve 42 will automatically reset to the normal position. Valve 42 is spring operated to provide substantially instantaneous switching between valve positions when actuated or reset. Time is measured by an internal escapement mechanism which maintains timing accuracy regardless of the supply pressure. However, pressure regulator 38 is utilized to protect the valve against pressure surges. An external dial provides for manual adjustment of the timing cycle.

When pressurized fluid source 34 is turned on, control valve 39 will produce an on control signal at input port 42-1 of pneumatic timing valve 42. The timing cycle is then initiated and an on control signal is generated at output port 42-2 and applied to pilot port 36-4. Valve 36 is actuated to vent appliance 37 to the atmosphere through exhaust port 36-3 to deflate appliance 37 and remove the pressure from the enclosed portion of the body. Pneumatic timing valve 42 continues to supply an off control signal from output port 42-5 to input port 41-1 of pneumatic timing valve 41 which remains in the normal position. At the end of the timing interval valve 42 will switch to its actuated position which produces an off control signal from output 42-2 and an on control signal from output 42-5. The off control signal is applied to pilot port 36-4 to automatically switch valve 36 to the normal position thereby connecting appliance 37 with the compressed gas source.

The on control signal from output port 42-5 is applied to input of 41-1 pneumatic timing valve 41 to initiate a timing interval during which valve 36 remains in the actuated position and appliance 37 is inflated to apply pressure to the enclosed portion of the body. At the end of its timing interval, pneumatic timing valve 41 switches to the actuated position to produce an on control signal from output port 41-5 to pilot port 39-4. Control valve 39 switches to its actuated position to produce an off control signal to input port 42-1 whereby pneumatic timing valve 42 is automatically reset. Valve 42 then produces an off control signal to input port 41-1 whereby valve 41 is automatically reset. In turn, valve 41 produces an off control signal to pilot port 39-4 whereby valve 39 is reset. Valve 42 also produces an on control signal to pilot port 36-4 to actuate valve 36 and vent appliance 37 to the atmosphere thereby starting the cycle again.

In summary, appliance 37 is inflated from pressurized fluid source 34 and pressure regulator 35 through valve 36 during a first predetermined period of time represented by the timing cycle associated with pneumatic timing valve 41 after valve control 39 supplies an on control signal at input port 41-1. Appliance 37 is deflated during a second predetermined period of time represented by the timing cycle associated with pneumatic timing valve 42 after control valve 39 supplies an on control signal at input port 42-1. Both timing cycles are manually adjustable so that each time interval may be varied as well as the total cycle time. As with the apparatus of FIG. 2, a typical cycle time may be 1 minute having 45 seconds of applied pressure and 15 seconds of no applied pressure.

FIG. 4 is a schematic diagram of the present invention having a fluidic timer. Pressurized fluid source 44 supplies compressed gas, typically a 50 p.s.i., to pressure regulator 45 which maintains a pressure of approximately 1 p.s.i. through four-way valve 46 to appliance 47. Compressed gas is also supplied through pressure regulator 48 to the elements of a fluidic timer which produces on and off control signals at a predetermined cyclic rate. Valve 46 responds to these control signals to intermittently inflate appliance 47 from pressurized fluid source 44 and deflate appliance 47 by venting it to the atmosphere. Element 46 is a four-way valve having exhaust port 46-1 normally connected to output port 46-2 which in turn is connected to appliance 47. Therefore, appliance 47 will be vented to the atmosphere in the normal valve position. Input port 46-3 is normally closed but is connected to output port 46-2 when an on control signal is received at pilot port 46-6 to supply pressurized fluid to appliance 47 whereby appliance 47 is inflated to apply pressure to the enclosed portion of the body. An on control signal is required at pilot port 46-7 to switch valve 46 back to the normal position after it has been actuated.

Element 49 is a fluidic Schmitt Trigger having supply port 49-1 which is connected to pressurized fluid source 44 through pressure regulator 48. Typically, fluidic elements require a supply pressure of 7.5 to 15 p.s.i. for operation. Therefore, pressure regulator 48 is typically adjusted to maintain a constant ten p.s.i. pressure to all the fluidic element supply ports. Schmitt Trigger 49 converts an analog signal at input port 49-2 to a digital output at any predetermined set-point between 1 and 15 p.s.i. When the signal applied at input port 49-2 reaches or exceeds the set-point, the output signal shifts from output port 49-3 to output port 49-4. Element 51 is fluidic time delay having supply port 51-1 connected to pressure regulator 48. Pressurized gas is applied to one of the delay ports 51-4, 51-5 and 51-6 while the other two are plugged. This pressurized gas bleeds off to the atmosphere through an external vent until a signal is applied at input port 51-2. Then the venting will stop and the pressure will build at output port 51-3 with a time constant determined by which delay port has been utilized. Typical time constants to reach 63% of a supply pressure of ten p.s.i. are 0.25 second for port 51-4, 0.5 second for port 51-5 and one second for port 51-6.

Schmitt trigger 49 and time delay 51 are connected together to form a free running oscillator which produces a train of timing pulses to the fluidic elements of the timer of the present invention. Assuming no signal at input port 49-2, there will be generated an output signal from output port 49-3 to delay port 51-6 and input port 51-2 of time delay 51. After one second the pressure at output port 51-3 will have reached 63% of the supply pressure of 10 p.s.i. If Schmitt Trigger 49 has been adjusted to have a set-point of 6.3 p.s.i., the output signal will shift from output port 49-3 to output port 49-4 to produce a timing pulse. This shift removes the supply from port 51-6 and the signal at input port 51-2 to reset time delay 51 and remove the output signal at output 51-3. Now Schmitt Trigger 49 resets to shift the output from output port 49-4 to output 49-3 and the pulse generation sequence will be repeated. Elements 52 and 53 are fixed linear fluid resistors which restrict gas flow and produce a pressure drop. Fluid resistor 52 is connected between output port 49-3 of Schmitt Trigger 49 and delay port 49-6 of time delay 49 to restrict gas flow into delay port 49-6. Without resistor 52, gas flow into delay port 49-6 will reduce the pressure at output port 49-3 below the level required to produce an input signal at input port 51-2. Resistor 52 adds to the internal resistance of time delay 51 to lengthen the time required to reach 63% of supply preessure. Therefore, the set-point of Schmitt Trigger 49 must be re-adjusted to a lower valve to produce a one second timing interval between output signals. Resistor 53 is connected between output port 51-3 of time delay 51 and input port 49-2 of Schmitt Trigger 49 to restrict gas flow into input port 49-2. Since input port 49-2 senses gas pressure with little requirement for gas flow, resistor 53 prevents rapid discharge from time delay 51 during signal buildup at input port 49-2 of Schmitt Trigger 49, thereby maintaining the time delay interval of time delay 51.

The pulse train produced by Schmitt Trigger 49 and time delay 51 is utilized to generate on and off control signals to valve 46. Output port 49-4 is connected to one input port of each of two AND-NAND gates 54 and 62. When the other input port of either AND-NAND gate is enabled by a signal from a flip-flop 59, an output pulse will be generated for each pulse received from Schmitt Trigger 49. These output pulses are totaled in pneumatic counters 55 and 64 which have preset totals corresponding to the number of pulses required to produce the on and off control signal time intervals. When either counter reaches its preset total, the state of the flip-flop is changed thereby switching between the on and off controls signals and the counter is reset for the next cycle.

Element 54 is fluidic AND-NAND gate having supply port 54-1 connected to pressure regulator 48 to receive compressed gas at 10 p.s.i. If there are no signals applied at input ports 54-2 and 54-3 or only one of these ports has a signal applied, there will be an output signal from output port 54-4 and no signal from output port 54-5. If signals are applied to both input ports, the output signal will shift from output port 54-4 to output port 54-5. Element 55 is a pneumatic counter which counts down one unit from a preset number each time a pulse is received at input port 55-2. When the count reaches zero, an internal valve opens and an output signal is provided from output port 55-3. The counter may then be reset either manually with reset button 56 or by a reset signal applied at reset port 55-4. A preset count of a maximum of 9999 may be entered by depressing digit buttons 57. Supply port 55-1 is connected to pressure regulator 48.

Elements 58 is a three-port valve having input port 58-1 connected to output port 58-2 in the normal valve position. In the acutated position, exhaust port 58-3 is connected to output port 58-2 which occurs when a control signal is applied at pilot port 58-4. Valve 58 may be reset to the normal position by applying a control signal at pilot port 58-5. Element 59 is a fluidic flip-flop having supply port 59-1 connected to pressure regulator 48. A signal at pilot port 59-2 will switch the output signal to output port 59-3, while a signal pilot port 59-4 will switch the output signal to output port 59-5. Element 61 is a fluidic OR-NOR gate having supply port 61-1 connected to pressure regulator 48. There is an output signal at output port 61-5 when there is no signal at input ports 61-2, 61-3 or 61-4. If a signal is applied to any one of the input ports the output signal will switch to output port 61-6.

The train of timing pulses from output 49-4 of Schmitt Trigger 49 is applied to input 54-2 of AND-NAND gate 54 and input port 62-3 of AND-NAND gate 62. Assuming that there has been a control signal applied at pilot port 59-2 of flip flop 59, an enabling signal will appear at output 59-3 to enable AND-NAND gate 54 at input 54-3 and to reset valve 46 to its normal position at pilot port 46-7. Each timing pulse at input 54-2 will remove the output signal from output 54-4 so that at the end of the timing pulse the output signal will return to produce a count pulse at input port 55-2 of counter 55. If the timing pulses from Schmitt Trigger 49 are generated at the rate of 1 pulse per second and counter 55 is preset to the number 15, then valve 46 will vent appliance 47 to the atmosphere through output port 46-2 and exhaust port 46-1 for 15 seconds. When counter 55 has counted to zero, it will produce a counter output signal at output port 55-3 to input port 61-3 of OR-NOR gate 61 which in turn switches its output signal from output port 61-5 to output port 61-6. This control signal from output port 61-6 is applied at pilot port 59-4 to switch the enabling signal fo flip-flop 59 from output port 59-3 to output port 59-5 thereby disabling AND-NAND gate 54 and enabling AND-NAND gate 62 at input port 62-2.

Before counter 55 reached zero, the control signal from output port 61-5 was applied to input port 63-3 of AND-NAND gate 63. Assuming pneumatic counter 64 has been reset, there will be no signal at input port 65-3 of OR-NOR gate 65 and there will be a control signal from output port 65-5 applied at input port 63-2. With control signals applied to both input ports, AND-NAND gate 63 will produce a control signal at output port 63-5 to pilot port 58-4 of valve 58 to actuate it and vent reset ports 55-4 and 64-4 of counters 55 and 64 to the atmosphere. When the control signal is removed from output port 61-5 at the time counter 55 reaches zero, AND-NAND gate 63 will switch its control signal from output port 63-5 to output port 63-4 to reset valve 58 to its normal position. Compressed gas is then applied to reset ports 55-4 and 64-4 to reset counters 55 and 64 through input port 58-1 and outpor port 58-2 of valve 58. When counter 55 resets, the signal is removed from output port 55-3 which causes OR-NOR gate 61 to switch its control signal back to output port 61-5 to produce a control signal at input port 63-3. AND-NAND gate 63 will switch its control signal from output port 63-4 to output port 63-5 and valve 58 will receive a signal at pilot port 58-4 to actuate it and remove the reset signal from counters 55 and 64.

Now each timing pulse from Schmitt Trigger 49 applied at input port 62-3 will remove the output signal from output 62-4 so that at the end of the timing pulse signal the output signal will reappear to produce a count pulse at input port 64-2 of counter 64. If counter 64 is preset to the number 45 with digit buttons 66, then valve 46 will connect appliance 47 to the compressed gas source through output port 46-2 and input port 46-3 for 45 seconds. When counter 64 has reached zero it will produce a counter output signal at output port 64-3 to input port 65-3 of OR-NOR gate 65 which in turn switches its control signal from output port 65-5 to output port 65-6. This signal is applied at pilot port 59-2 to switch the enabling signal of flip-flop 59 from output port 59-5 to output port 59-3 thereby disabling AND-NAND gate 62 and enabling AND-NAND gate 54 at input port 54-3.

When OR-NOR gate 65 switches its control signal from output port 65-5 to output port 65-6, the control signal is removed from input port 63-2 and AND-NAND gate 63 switches its control signal from output port 63-5 to 63-4. Reset valve 58 is reset to its normal position by the control signal at pilot port 58-5 from output port 63-4 to generate a reset signal at reset port 64-4 of counter 64. The resetting of counter 64 removes the counter output signal from output port 64-3 and OR-NOR gate 65 switches its control signal from output port 65-6 to output port 65-5 to produce a control signal at input 63-2. AND-NAND gate 63 switches its control signal from output port 63-4 to output port 63-5 thereby actuating valve 58 at pilot port 58-4 and removing the reset signal from counters 55 and 64.

In summary, Schmitt Trigger 49 and time delay 51 function as a free running oscillator to generate a train of timing pulses to AND-NAND gates 54 and 62. Flip-flop 59 enables AND-NAND gate 54 to generate pulses to counter 55 which counts down from a preset number, typically fifteen, to produce a fifteen second time interval if the timing pulses are one second apart. During this fifteen second period, valve 46 is in its normal position having been reset by the enabling signal from flip-flop 59. In the normal position, valve 46 vents appliance 47 to the atmosphere to deflate it and remove pressure from that portion of the body enclosed by appliance 47. When counter 55 reaches zero after fifteen seconds, it sends a counter output signal to OR-NOR gate 61 which in turn sends a control signal to flip-flop 59. Flip-flop 59 switches its enabling signal from AND-NAND gate 54 to AND-NAND gate 62 while the control signal is removed from AND-NAND gate 63. AND-NAND gate 63 switches its control signal to pilot port 58-5 to reset valve 58 to its normal position thereby resetting counters 55 and 64.

Now counter 64 counts down from a preset number, typically forty-five, while valve 46 is in its actuated position to supply compressed gas to inflate appliance 47 for 45 seconds at 1 p.s.i. When counter 64 reaches zero it sends a counter output signal to OR-NOR gate 65 while switches its control signal to input port 59-3. Flip-flop 59 switches its enabling signal to AND-NAND gate 54 from AND-NAND gate 62 while the control signal is removed from AND-NAND gate 63. AND-NAND gate 63 switches its control signal to pilot port 58-5 to reset valve 58 to its normal position thereby resetting counters 55 and 64. When counters 55 and 64 are reset, the counter output signal is removed from the OR-NOR gate associated with the counter which has counter to zero. Now there are control signals at both inputs to AND-NAND gate 63 which switches its control signal to pilot port 58-4 to actuate reset valve 58 and remove the reset from counters 55 and 64. As long as pressurized fluid source 44 remains turned on appliance 47 will be cycled automatically with the inflation period determined by the preset number in counter 64 and the deflation period determined by the preset number in counter 55. Counters 55 and 64 may also be reset manually with reset buttons 56 and 67 respectively at any point in the cycle.

Although not shown, pressurized fluid sources 17, 34 and 44 and pressure regulators 18, 35, 38, 45 and 48 of FIGS. 2, 3 and 4 may be provided with pressure meters for a visual indication of system pressure during operation. In addition, valves 19, 22, 23, 24 of FIG. 3, valves 36, 39, 41 and 42 of FIG. 3 and valve 46 of FIG. 4 may be provided with flag indicators, not shown, which display whether the valve is in the normal or actuated position. These indicators may be utilized to check the operation of the timer.

The use of fluid pressure, particularly compressed air, as the drive for the clocking and logic functions in the control of the application and release of fluid pressure on a therapeutic appliance, such as a double-walled boot for receiving a patient's leg and foot, lends itself to coupling to a single source of compressed fluid. Each of the embodiments shown are adaptable to operation with compressed air. Their logic is arranged such that the initial function on turning on of the system, as by the application of air pressure to the logic controls, is to initiate the filling of the therapeutic appliance with pressurized fluid. Each embodiment also is arranged to automatically drain the therapeutic appliance of pressurized fluid when the system is turned off.

While there is explained and illustrated the preferred embodiment of our invention, it is to be understood that within the spirit and the scope of the following claims the invention may be practiced otherwise than as specifically illustrated and described.

We claim:

1. Therapeutic compression apparatus for intermittently supplying fluid under pressure to an appliance enveloping a portion of a body to be treated, comprising:

a source of fluid under pressure;

timing means actuated by said fluid under pressure including a first fluid driven timer for generating a first signal during a predetermined on time interval of adjustable duration, a second fluid driven timer for generating a second signal during a a predetermined off time interval of adjustable duration, and a timing control means actuated by said fluid under pressure in response to said timing signals to alternately actuate said first and second timers;

first means for applying fluid from said source to said timing means at a first pressure;

second means for applying fluid from said source to said appliance at a second pressure different and independently adjustable from said first pressure; and appliance control valve means responsive to said first signal for connecting said second means for applying fluid from said source to said appliance and responsive to said second signal for venting said appliance to the atmosphere.

2. An apparatus as defined in claim 1 wherein said appliance control fluid is a compressed gas.

3. An apparatus as defined in claim 1 wherein said second means is a pressure regulator connected between said fluid source and said valve means.

4. An apparatus as defined in claim 3 wherein said pressure regulator maintains an approximately one pound per square inch fluid pressure.

5. An apparatus as defined in claim 1 wherein said valve means includes a valve having a pilot port connected to said timing means whereby said valve switches to an actuated position to couple said fluid source to said appliance in response to said first signal at said pilot port and said valve switches to a normal position to vent said appliance to the atmosphere in response to said second signal at said pilot port.

6. An apparatus as defined in claim 5 wherein said first signal is the presence of fluid pressure from said first means at said pilot port and said second signal is the presence of atmospheric pressure at said pilot port.

7. An apparatus as defined in claim 5 wherein said first timer includes an adjustable delay valve for adjusting said predetermined on time interval.

8. An apparatus as defined in claim 7 wherein said first delay valve includes fixed time delay means for delaying switching to an actuated position for a predetermined time interval after said timing control valve switches to an actuated position.

9. An apparatus as defined in claim 5 wherein said second timer includes an adjustable delay valve for adjusting said predetermined off time interval.

10. An apparatus as defined in claim 9 wherein said second delay valve includes fixed time delay means for delaying switching to an actuated position for a predetermined time interval after said timing control valve switches to an normal position.

11. Therapeutic compression apparatus for intermittently supplying fluid under pressure to an appliance enveloping a portion of a body to be treated, comprising:

a source of fluid under pressure;

timing means actuated by said fluid under pressure including fluidic oscillator means for generating a train of timing pulses, first and second presettable counter means responsive to said pulses, and gate means for selectively coupling said oscillator means to said counter means to generate a first signal during a predetermined on time interval of a duration adjustable by the preset count of said first counter and a second signal during a predetermined off time interval of a duration adjustable by the preset count of said second counter; first means for applying fluid from said source to said timing means at a first pressure; second means for applying fluid from said source to said appliance at a second pressure independently adjustable and different from said first pressure; and appliance control valve means responsive to said first signal for connecting said second means for applying fluid from said source to said appliance and responsive to said second signal for venting said appliance to the atmosphere.

12. An apparatus as defined in claim 11 wherein said fluidic oscillator means includes a fluidic Schmitt Trigger.

13. An apparatus as defined in claim 11 wherein said gate means includes a first fluidic AND-NAND gate having a first input port connected to said oscillator means for receiving said train of timing pulses and a second input port for receiving a first enabling signal whereby said first AND-NAND gate generates an output pulse in response to the coincidence of one of said timing pulses and said first enabling signal.

14. An apparatus as defined in claim 13 wherein said counter means comprises said first timer and includes a first pneumatic counter connected to said first AND-NAND gate for generating a first counter output signal in response to counting a first predetermined number of said output pulses.

15. An apparatus as defined in claim 14 wherein said timing means includes a first fluidic OR-NOR gate connected to said first counter for generating a first control signal when said first counter is counting and a second control signal when said first counter reaches said first predetermined number of output pulses.

16. An apparatus as defined in claim 15 wherein said gate means includes a second fluidic AND-NAND gate having a first input port connected to said oscillator means for receiving said train of timing pulses and a second input port for receiving a second enabling signal whereby said second AND-NAND gate generates an output pulse in response to the coincidence of one of said timing pulses and said second enabling signal.

17. An apparatus as defined in claim 16 wherein said counter means comprises said second timer and includes a second pneumatic counter connected to said second AND-NAND gate for generating a second counter output signal in response to counting a second predetermined number of said output pulses.

18. An apparatus as defined in claim 17 wherein said timing means includes a second fluidic OR-NOR gate connected to said second counter for generating a third control signal when said counter is counting and a fourth control signal when said second counter reaches said second predetermined number of output pulses.

19. An apparatus as defined in claim 18 wherein said timing means includes a fluidic flip-flop connected to said first and second OR-NOR gates, said first and second AND-NAND gates and said valve means for generating said first enabling signal and said first signal in response to said fourth control signal and for generating said second enabling signal and said second signal in response to said second control signal.

20. An apparatus as defined in claim 19 wherein said timing means includes a third fluidic AND-NAND gate connected to said first and second OR-NOR gates for generating a fifth control signal in response to said first and third control signals and a sixth control signal in response to one of said first or third control signals.

21. An apparatus as defined in claim 20 wherein said timing means includes a reset valve having first and second pilot ports connected to said third fluidic AND-NAND gate whereby said reset valve switches to a normal position to couple said fluid source to the reset inputs of said first and second counters to reset said counters in response to said sixth control signal at said first pilot port and switches to an actuated position to vent the reset inputs of said counters in response to said fifth control signal at said second pilot port.

* * * * *